US009844811B2

(12) United States Patent
Nakai et al.

(10) Patent No.: US 9,844,811 B2
(45) Date of Patent: Dec. 19, 2017

(54) RAW MATERIAL POWDER FOR POWDER METALLURGY

(71) Applicant: Diamet Corporation, Niigata-shi (JP)

(72) Inventors: Takashi Nakai, Niigata (JP); Kinya Kawase, Niigata (JP)

(73) Assignee: DIAMET CORPORATION, Niigata-Shi (JP)

( * ) Notice: Subject to any disclaimer, the term of this patent is extended or adjusted under 35 U.S.C. 154(b) by 291 days.

(21) Appl. No.: 14/429,682

(22) PCT Filed: Dec. 2, 2013

(86) PCT No.: PCT/JP2013/082373
§ 371 (c)(1),
(2) Date: Mar. 19, 2015

(87) PCT Pub. No.: WO2014/097871
PCT Pub. Date: Jun. 26, 2014

(65) Prior Publication Data

US 2015/0283609 A1 Oct. 8, 2015

(30) Foreign Application Priority Data

Dec. 17, 2012 (JP) ..... 2012-274446

(51) Int. Cl.

| | |
|---|---|
| ***B22F 1/00*** | (2006.01) |
| ***C10M 105/70*** | (2006.01) |
| ***C10M 105/00*** | (2006.01) |
| ***C10M 105/68*** | (2006.01) |
| ***B22F 3/10*** | (2006.01) |

(52) U.S. Cl.
CPC ..... *B22F 1/0059* (2013.01); *B22F 1/0062* (2013.01); *B22F 3/10* (2013.01); *C10M 105/00* (2013.01); *C10M 105/68* (2013.01); *C10M 105/70* (2013.01); *B22F 2001/0066* (2013.01); *B22F 2998/10* (2013.01); *C10M 2207/1423* (2013.01); *C10M 2215/08* (2013.01); *C10M 2215/0806* (2013.01); *C10M 2215/2225* (2013.01); *C10N 2220/082* (2013.01); *C10N 2240/40* (2013.01)

(58) Field of Classification Search
CPC ..... B22F 1/0059; B22F 1/0062; B22F 3/10; B22F 2998/10; B22F 2001/0066; C10M 105/00; C10M 105/68; C10M 105/70; C10M 2215/08; C10M 2207/1423; C10M 2215/2225; C10M 2215/0806; C10N 2220/082; C10N 2240/40
See application file for complete search history.

(56) References Cited

U.S. PATENT DOCUMENTS

| | | | | |
|---|---|---|---|---|
| 2,822,270 | A * | 2/1958 | Kirkpatrick | B22F 1/0059 419/36 |
| 3,973,843 | A | 8/1976 | Lindblad et al. | |
| 4,208,448 | A | 6/1980 | Panaccione | |
| 4,817,123 | A | 3/1989 | Sones et al. | |
| 5,746,783 | A | 5/1998 | Compere et al. | |
| 5,874,388 | A | 2/1999 | Hsu | |
| 7,150,839 | B1 | 12/2006 | Saulsbery et al. | |
| 2001/0038802 | A1 | 11/2001 | Ozaki et al. | |
| 2003/0073017 | A1 | 4/2003 | Fields et al. | |
| 2004/0129180 | A1 | 7/2004 | Boggs | |
| 2004/0171511 | A1 | 9/2004 | Nagai et al. | |
| 2004/0219230 | A1 | 11/2004 | Tanaka | |
| 2004/0235682 | A1 | 11/2004 | Van Dam et al. | |
| 2005/0019421 | A1 | 1/2005 | Hobbs et al. | |
| 2006/0016368 | A1 | 1/2006 | Ozawa et al. | |
| 2007/0089562 | A1 | 4/2007 | Unami et al. | |
| 2008/0206093 | A1 | 8/2008 | Muller et al. | |
| 2009/0081806 | A1 | 3/2009 | Reeves, III et al. | |
| 2012/0111146 | A1* | 5/2012 | Kawano | C22C 38/00 75/252 |

FOREIGN PATENT DOCUMENTS

| | | | |
|---|---|---|---|
| CN | 1839006 | A | 9/2006 |
| EP | 2436462 | A | 4/2012 |
| JP | 49-60222 | | 6/1974 |
| JP | 52-30218 | | 3/1977 |
| JP | 52-116724 | | 9/1977 |
| JP | 53-031759 | A | 3/1978 |
| JP | 55-60248 | A | 5/1980 |
| JP | 55-100304 | | 7/1980 |
| JP | 57-168745 | A | 10/1982 |
| JP | 59-149955 | A | 8/1984 |
| JP | 60-234223 | A | 11/1985 |
| JP | 62-7797 | A | 1/1987 |
| JP | 62-033431 | A | 2/1987 |
| JP | 62-210988 | A | 9/1987 |

(Continued)

OTHER PUBLICATIONS

Office Action dated Mar. 28, 2016 for the corresponding Chinese Patent Application No. 201380049119.1.

(Continued)

*Primary Examiner* — Anthony J Zimmer
(74) *Attorney, Agent, or Firm* — Leason Ellis LLP

(57) ABSTRACT

Provided is a raw material powder for powder metallurgy, capable of preventing stains, surface defects and decarburization of a sintered body, improving strength and density thereof. The raw material powder for powder metallurgy is for use in the production of a sintered body that is sintered at a temperature of not lower than 500° C., composed of a mixture of a metal powder and a lubricant, in which the lubricant is melamine cyanurate or terephthalic acid. Alternatively, the raw material powder for powder metallurgy is for use in the production of a sintered body that is sintered at a temperature of not lower than 500° C, composed of a mixture of a metal powder, a first lubricant and a second lubricant, in which the first lubricant is melamine cyanurate or terephthalic acid, while the second lubricant is preferably erucic acid amide or stearic acid amide.

2 Claims, 4 Drawing Sheets

(56) References Cited

FOREIGN PATENT DOCUMENTS

| | | | | |
|---|---|---|---|---|
| JP | 63-099002 | A | 4/1988 | |
| JP | 02-019421 | A | 1/1990 | |
| JP | 02-127499 | A | 5/1990 | |
| JP | 02-204355 | A | 8/1990 | |
| JP | 02-228362 | A | 9/1990 | |
| JP | 03-024289 | A | 2/1991 | |
| JP | 03-202458 | A | 9/1991 | |
| JP | 04-246452 | A | 9/1992 | |
| JP | 05-214272 | A | 8/1993 | |
| JP | 06-039731 | A | 2/1994 | |
| JP | 06-158085 | A | 6/1994 | |
| JP | 06-159369 | A | 6/1994 | |
| JP | 06-192540 | A | 7/1994 | |
| JP | 06-228763 | A | 8/1994 | |
| JP | 06-280181 | A | 10/1994 | |
| JP | 07-041716 | A | 2/1995 | |
| JP | 07-241774 | A | 9/1995 | |
| JP | 07-289538 | A | 11/1995 | |
| JP | 09-059663 | A | 3/1997 | |
| JP | 09-255983 | A | 9/1997 | |
| JP | 10-265611 | A | 10/1998 | |
| JP | 10-330731 | A | 12/1998 | |
| JP | 2000-138198 | A | 5/2000 | |
| JP | 2000-335164 | A | 12/2000 | |
| JP | 2001-003071 | A | 1/2001 | |
| JP | 2001-181665 | A | 7/2001 | |
| JP | 2001-332517 | A | 11/2001 | |
| JP | 2003-015365 | A | 1/2003 | |
| JP | 2003-049188 | A | 2/2003 | |
| JP | 2003-336100 | A | 11/2003 | |
| JP | 2004-503632 | A | 2/2004 | |
| JP | 2004-067424 | A | 3/2004 | |
| JP | 2004-516223 | A | 6/2004 | |
| JP | 2004-189795 | A | 7/2004 | |
| JP | 2004-315762 | A | 11/2004 | |
| JP | 2004-346326 | A | 12/2004 | |
| JP | 2005-505908 | A | 2/2005 | |
| JP | 2005-105323 | A | 4/2005 | |
| JP | 2005-307348 | A | 11/2005 | |
| JP | 2006-057076 | A | 3/2006 | |
| JP | 2006-083503 | A | 3/2006 | |
| JP | 2006-257539 | A | 9/2006 | |
| JP | 2006-269183 | A | 10/2006 | |
| JP | 2006-335838 | A | 12/2006 | |
| JP | 2007-157373 | A | 6/2007 | |
| JP | 2008-050627 | A | 3/2008 | |
| JP | 2008-231443 | A | 10/2008 | |
| JP | 2009-091364 | A | 4/2009 | |
| JP | 2009-237274 | A | 10/2009 | |
| JP | WO 2010137735 | A1 * | 12/2010 | ..... C22C 38/00 |
| JP | 2011-184708 | A | 9/2011 | |
| JP | 2011-249058 | A | 12/2011 | |
| JP | 2012-506457 | A | 3/2012 | |
| JP | 2012-235086 | A | 11/2012 | |
| JP | 2013-087328 | A | 5/2013 | |
| WO | WO-01/96440 | A | 12/2001 | |
| WO | WO-02/051773 | A | 7/2002 | |
| WO | WO-03/033616 | A | 4/2003 | |
| WO | WO-2006/038631 | A | 4/2006 | |
| WO | WO-2010/048139 | A | 4/2010 | |

OTHER PUBLICATIONS

Extended European Search Report dated Jun. 22, 2016 for the corresponding European Patent Application No. 13864732.6.

Office Action dated Jun. 29, 2016 for the corresponding Korean Patent Application No. 2015-7004440.

Office Action dated Oct. 27, 2016 for the corresponding Korean Patent Application No. 10-2015-7004440.

Office Action dated Oct. 18, 2016 for the corresponding Chinese Patent Application No. 201380049119.1.

Office Action dated Dec. 18, 2015 for the corresponding Korean Patent Application No. 2015-7004440.

International Search Report dated Jan. 7, 2014 for the corresponding PCT Application No. PCT/JP2013/082373.

Office Action dated Sep. 7, 2017 for the corresponding Chinese Patent Application No. 201380049119.1.

Wang Pan Xin, "Powder metallurgy", *Metallurgical Industry Press*, May 1995, pp. 150.

* cited by examiner

Dot-shaped stains are observed on the bottom portion of a disc shape

No stains are observed on the bottom portion of a disc shape

Surface defects are observed as depressed areas on a side surface

No surface defect can be observed on a side surface

RAW MATERIAL POWDER FOR POWDER METALLURGY

CROSS-REFERENCE TO RELATED PATENT APPLICATIONS

This application is a U.S. National Phase Application under 35 U.S.C. §371 of International Patent Application No. PCT/JP2013/082373, filed Dec. 2, 2013, and claims the benefit of Japanese Patent Application No. 2012-274446, filed on Dec. 17, 2012, all of which are incorporated by reference in their entirety herein. The International Application was published in Japanese on Jun. 26, 2014 as International Publication No. WO/2014/097871 under PCT Article 21(2).

FIELD OF THE INVENTION

The present invention relates to a raw material powder for powder metallurgy, specifically to one sintered at not lower than 500 degrees C. to produce a sintered body.

BACKGROUND OF THE INVENTION

In a mixture of a metal power and a lubricant, there have generally been used, as a lubricant, a metal soap such as zinc stearate, and an amide-based lubricant such as ethylenebisstearamide, fatty acid amide, etc. However, in a process for producing a metallic sintered body through powder molding, using a mixture of a metal powder and a lubricant, and then sintering the same at not lower than 500 degrees C. to eliminate the lubricant, there have been the following problems:

1 Stains on Sintered Body

When a metal soap is used as a lubricant, there has been a problem that at the time of sintering, a sintered body gets stains due to residual metallic components contained in the lubricant. To prevent such stains from being caused by the residual metallic components, there have been used, as a lubricant, amide-based lubricants including no metallic components. Using such amide-based lubricants, however, does not provide a complete solution to reduce stains to zero.

2 Surface Defect of Sintered Body

In the case that conventional lubricants are used, they are fused due to friction heat generated on a mold surface at the time of molding, resulting in lubricant agglomerate or mass being formed on the surface of the sintered body. There has been a problem, however, that areas where the lubricants were agglomerated remain as defective areas after they are decomposed at the time of sintering.

3 Strength of Sintered Body

When using conventional lubricants, there has been a problem that strength decreases due to the above-mentioned surface defect, etc.

4 Density of Sintered Material

When using conventional lubricants, a compacting pressure has to be increased to enhance the density of a compact, leading to a problem that a mold is subjected to such a heavy load that it is easily broken. For this reason, it has been impossible to satisfy High Density, High Strength and High Hardness specifications.

5 Decarburization of Sintered Body

When a black lead or graphite is included as an additive, it reacts with air to be decarburized, leading to a problem of decreased strength of a sintered body.

CONVENTIONAL ART DOCUMENTS

Patent Documents

Patent document 1: Japanese unexamined patent application publication No. 2005-105323

Patent document 2: Japanese unexamined patent application publication No. 2011-184708

SUMMARY OF THE INVENTION

Therefore, it is an object of the present invention to provide a raw material powder for powder metallurgy, capable of preventing stains, surface defects and decarburization of a sintered body, improving strength and density thereof.

Means for Solving the Problem

As a result of study to solve the above-mentioned problem, it has been found that when using, as a lubricant, such amide-based lubricants or any substances that melt and get into a liquid state at high temperature, particularly noticeable stains are produced at a stepped portion or a dished portion. From this finding, it was assumed that the stains are produced because the lubricants, which were once melted, are allowed to collect in such stepped portion or dished portion when sintering, to which non-volatile contents, etc. in a furnace adhere during a certain period before the lubricants are decomposed. Further, level of stains differed depending on the type of fatty acid amides, and less stains were observed when using erucic acid amide (decomposed at about 250 to 320 degrees C. in a nitrogen atmosphere) or stearic acid amide (decomposed at about 240 to 310 degrees C. in a nitrogen atmosphere) having a comparatively low decomposition temperature, than when using ethylenebisstearamide (decomposed at about 300 to 370 degrees C. in a nitrogen atmosphere) having a comparatively high decomposition temperature, and thus, it was assumed that lubricants that are decomposable soon after melting produce less stains.

As a result of extensive studies based on these findings, the inventors of the present invention have come up with an idea of using melamine cyanurate or terephthalic acid as an insoluble lubricant in the first place, and have reached the present invention.

That is, a raw material powder for powder metallurgy of the present invention is as follows:

(1) A raw material powder for powder metallurgy that is sintered at a temperature of not lower than 500° C. and used to produce a sintered body, comprising a mixture of a metal powder and a lubricant, wherein the lubricant is one or two of melamine cyanurate and terephthalic acid.

(2) A raw material powder for powder metallurgy that is sintered at a temperature of not lower than 500° C. and used to produce a sintered body, comprising a mixture of a metal powder, a first lubricant and a second lubricant, wherein the first lubricant is either melamine cyanurate or terephthalic acid.

(3) In the above (2), said second lubricant is either erucic acid amide or stearic acid amide.

(4) In the above (1), said lubricant is either melamine cyanurate or terephthalic acid each having an average particle diameter of 0.1 to 200 μm.

(5) In the above (2), said first lubricant is either melamine cyanurate or terephthalic acid each having an average particle diameter of 0.1 to 200 μM.

(6) In the above (3), said second lubricant is either erucic acid amide or stearic acid amide each having an average particle diameter of 0.1 to 200 μm.

(7) In the above (3), said first lubricant is melamine cyanurate having an average particle diameter of 0.1 to 3 μm, and said second lubricant is erucic acid amide having an average particle diameter of 60 to 200 μm.

(8) In the above (7), a compounding ratio of said first lubricant to said second lubricant is in a range of 90 to 50%:10 to 50%.

(9) In the above (3), said first lubricant is melamine cyanurate having an average particle diameter of 0.1 to 3 μm, and said second lubricant is stearic acid amide having an average particle diameter of 0.1 to 200 μm.

(10) In the above (9), a compounding ratio of said first lubricant to said second lubricant is in a range of 90 to 10%:10 to 90%.

(11) In any one of the above (1) to (10), said lubricant is treated so as to adhere to said metal powder.

(12) In any one of the above (1) to (10), said lubricant is treated so as to change the form thereof.

Effects of the Invention

According to the present invention, stains, surface defects and decarburization of a sintered body can be prevented, thus improving strength and density thereof.

BRIEF DESCRIPTION OF THE DRAWINGS

These and other features and advantages of the present invention will become more readily appreciated when considered in connection with the following detailed description and appended drawings, wherein like designations denote like elements in the various views, and wherein.

DETAILED DESCRIPTION OF THE INVENTION

Mode for Carrying Out the Invention

Figure 1:
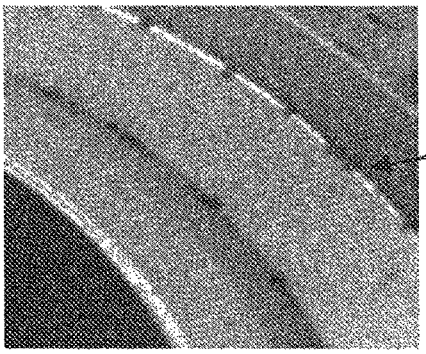
FIG. 1 is a photograph showing the top surface of a sintered body according to a comparative example where only ethylenebisstearamide was used as the lubricant.

A raw material powder for powder metallurgy of the present invention is a raw material powder for powder metallurgy that is sintered at a temperature of not lower than 500° C. and used to produce a sintered body. Particularly, this raw material powder for powder metallurgy is obtained by mixing a metal powder and a lubricant(s). This lubricant is one or two of melamine cyanurate and terephthalic acid.

Each of melamine cyanurate and terephthalic acid is a type of substance that does not contain a metal component(s); but decomposes or sublimates at a temperature not higher than 500° C. without melting at a high temperature. For this reason, melamine cyanurate or terephthalic acid will disappear at the time of performing sintering, without affecting the sintered body. Further, melamine cyanurate or terephthalic acid exhibits a high performance as a solid lubricant. Thus, by using melamine cyanurate or terephthalic acid as a lubricant, stains, a surface defect(s) and decarburization of the sintered body can be prevented at the time of performing sintering while allowing the melamine cyanurate or terephthalic acid to exhibit a high performance as a lubricant at the time of carrying out molding. In addition, as a result of using melamine cyanurate or terephthalic acid as a lubricant, a surface defect(s) are prevented such that the strength of the sintered body can be improved. Also, by using melamine cyanurate or terephthalic acid as a lubricant, a high compressibility can be achieved at the time of carrying out molding, thereby not only reducing a molding pressure, but also preventing a mold breakage, thus satisfying requirements such as high density, high strength and high hardness. Moreover, one advantage is that both melamine cyanurate mainly intended as a raw material powder of a flame retardant; and terephthalic acid mainly intended as a raw material powder for producing a PET resin, are inexpensive and can be acquired easily.

Here, melamine cyanurate is generally intended as a flame retardant for architectural materials or the like (Japanese Unexamined Patent Application Publication No. Sho 53-31759). Further, melamine cyanurate may also be intended as a mold release agent for casting die (Japanese Unexamined Patent Application Publication No. Sho 57-168745); a tracking resistance agent for arc-resistance material (Japanese Unexamined Patent Application Publication No. Sho 59-149955); a lubricant for magnetic recording medium (Japanese Unexamined Patent Application Publication No. Sho 60-234223); a laser reflection agent (Japanese Unexamined Patent Application Publication No. Hei 2-19421); a lubricity improving agent of hot rolling oil (Japanese Unexamined Patent Application Publication No. Hei 2-127499); a blocking-preventing agent of bituminous material (Japanese Unexamined Patent Application Publication No. Hei 2-228362); a regenerant of carbonitrided salt bath (Japanese Unexamined Patent Application Publication No. Hei 4-246452); a property improving agent of paint (Japanese Unexamined Patent Application Publication No. Hei 5-214272); a lubricant for grind stone (Japanese Unexamined Patent Application Publication No. Hei 6-039731); a rust-preventive agent of film agent for metal working (Japanese Unexamined Patent Application Publication No. Hei 6-158085); a self-lubricating agent for bearing (Japanese Unexamined Patent Application Publication No. Hei 6-159369); an acid stabilizing agent for polyoxymethylene (Japanese Unexamined Patent Application Publication No. Hei 6-192540); an electrodeposition improving agent for cationic electrodeposition steel sheet (Japanese Unexamined Patent Application Publication No. Hei 6-228763); a lubricant for paper machine (Japanese Unexamined Patent Application Publication No. Hei 6-280181); a hardening agent of solder mask ink (Japanese Unexamined Patent Application Publication No. Hei 7-041716); a pseudo-pore agent of grind stone (Japanese Unexamined Patent Application Publication No. Hei 7-241774); a fingerprint detection agent (Japanese Unexamined Patent Application Publication No. Hei 7-289538); a lubricant for carbide mold guide pin (Japanese Unexamined Patent Application Publication No. Hei 9-59663); a grease lubricant (Japanese Unexamined Patent Application Publication No. Hei 9-255983); an abrasion resistance agent for friction material (Japanese Unexamined Patent Application Publication No. Hei 10-330731); an abrasion restriction material retarder of writing material (Japanese Unexamined Patent Application Publication No. 2000-335164); a solid lubricant for hot rolling (Japanese Unexamined Patent Application Publication No. 2001-003071); an anti-seize agent of lubricant oil for cold working (Japanese Unexamined Patent Application Publication No. 2001-181665); a lubricant of polishing liquid (Japanese Unexamined Patent Application Publication No. 2001-332517); a rust-preventive agent of lubricant for cold drawing process (Japanese Unexamined Patent Application Publication No. 2003-049188); a fuel agent of gas generating agent for airbag (Japanese Unexamined Patent Application Publication No. 2004-067424); a lubricant of water-dispersible metal processing agent (Japanese Unexamined Patent Application Publication No. 2004-315762); a lubricant of water-based lubricating film treatment agent (Japanese Unexamined Patent Application Publication No. 2006-335838); a strength improving agent of powder magnetic core (Japanese Unexamined Patent Application Publication No. 2008-231443); an electrification imparting agent of toner (Japanese Unexamined Patent Application Publication No. 2009-237274); a crystallization promoter of polymer piezoelectric material (Japanese Unexamined Patent Application Publication No. 2012-235086); a nitrogen oxide reducing agent of diesel fuel (U.S. Pat. No. 5,746,783); a deposition-preventing and thermal-stabilizing agent of a lubricant for disc brake caliper pin (U.S. Pat. No. 5,874,388).

Further, terephthalic acid is generally intended as a raw material for producing a polyethylene terephthalate (PET resin). PET resin, developed by E. I. du Pont de Nemours and Company, in 1967, has been used in great quantities ever since beverage PET bottles were developed in 1973, while PET resins have also been intended for use with clothing synthetic fibers and general molding products, etc. Other applications thereof include: a raw material for producing chemicals such as terephthalic acid compounds (there exist a number of publications); lubricants of electrographic imaging agent (JP Unexamined Patent Application Publication No. Sho 49-60222); disintegrating agent of mold (JP Unexamined Patent Application Publication No. Sho 52-116724); reinforcing agents for casting lost wax composition (JP Unexamined Patent Application Publication No. Sho 52-30218); acid cleaning agent for fluorescent substance of fluorescent discharge lamp (JP Unexamined Patent Application Publication No. Sho 55-60248); plant bioregulator agent (Japanese Unexamined Patent Application Publication No. Sho 55-100304); acidic agent for disinfecting detergent (Japanese Unexamined Patent Application Publication No. Sho 61-122847); bleaching agent (Japanese Unexamined Patent Application Publication No. Sho 62-7797); sublimation agent for semiconductor device substrate (Japanese Unexamined Patent Application Publication No. Sho 62-33431); xanthine oxidase stabilizing agent (Japanese Unexamined Patent Application Publication No. Sho 62-210988); electrochemical treatment agent of aluminum (Japanese Unexamined Patent Application Publication No. Hei 3-24289); additive for masticating natural rubber (Japanese Unexamined Patent Application Publication No. Hei 10-265611); reducing and rinsing agent for semiconductor substrate cleaner (Japanese Unexamined Patent Application Publication No. 2000-138198); acidic toner charge-controlling agent (Japanese Unexamined Patent Application Publication No. 2003-15365); fixation agent for allergen removing agent (Japanese Unexamined Patent Application Publication No. 2003-336100); cleaning agent for liquid detergent (Japanese Unexamined Patent Application Publication No. 2004-189795); corrosion inhibitor for diesel lubricant oil (Japanese Unexamined Patent Application Publication No. 2004-346326); performance improver for inkjet recording ink (Japanese Unexamined Patent Application Publication No. 2006-57076); paper quality improving agent (Japanese Unexamined Patent Application Publication No. 2006-83503); stabilizing agent for electrolyte of fuel cell (Japanese Unexamined Patent Application Publication No. 2006-269183); surface active agent for electronic components mounting bonding material (Japanese Unexamined Patent Application Publication No. 2007-157373); corrosion inhibiting agent for stainless steel (Japanese Unexamined Patent Application Publication No. 2008-50627); thickener for external preparation of carbon dioxide (Japanese Unexamined Patent Application Publication No. 2009-91364); heat generation inhibitor for anode for lithium ion secondary battery (Japanese Unexamined Patent Application Publication No. 2011-249058); epoxy resin composition curing retardant (Japanese Unexamined Patent Application Publication No. 2004-503632); propellant stabilizing agent (Japanese Unexamined Patent Application Publication No. 2004-516223); fuel cell coolant (Japanese Unexamined Patent Application Publication No. 2005-505908); complexing agent for copper cleaning protective agent (Japanese Unexamined Patent Application Publication No. 2012-506457); acidic agent for pesticides (WO2006/038631); fluorescent agents (U.S. Pat. No. 7,150,839); carbon scavenger (U.S. Patent Application Publication No. 2004-0129180); disinfecting compositions (U.S. Patent Application Publication No. 2005-0019421); deodorant (U.S. Patent Publication No. 2008-0206093); compositions for pH control (U.S. Patent Publication No. 2009-0081806).

The reason for limiting the usage of the raw material powder for powder metallurgy of the present invention to that producing such sintered body that is sintered at the temperature of not lower than 500° C., is as follows. That is, while the sintering temperatures of most metal powders are not lower than 500° C., a desirable strength as a sintered body cannot be achieved if melamine cyanurate or terephthalic acid remains in the sintered body as a result of employing a temperature causing melamine cyanurate or terephthalic acid as a lubricant to remain in the sintered body. Here, melamine cyanurate completely decompose or sublimate at a temperature of about 360 to 430° C.; and terephthalic acid completely decompose or sublimate at a temperature of about 310 to 380° C. Both melamine cyanurate and terephthalic acid do not have a melting point, and are thus substances that do not melt.

The reason for limiting the essential lubricant of the present invention to melamine cyanurate or terephthalic acid is as follows. That is, substances that do not have a melting point and thus do not melt shall theoretically not cause the sintered body to be contaminated as soot or dirt inside the furnace adheres to a molten lubricant. There exist other substances that also do not have a melting point and thus do not melt. Such substances can potentially be employed as the essential lubricant of the present invention. As such other substances that do not melt, the inventors of the present invention considered using melamine, melamine resin, cyanuric acid, urea, urea-formaldehyde resin (urea resin), adamantane, cellulose and aramid resin. It was found that while all of them were not at a non-usable level, they were slightly imperfect when used as substitutes for the lubricants conventionally employed as the lubricants for raw material powder for powder metallurgy due to the fact that they are in part inferior to the conventional lubricants in, for example, lubricity, compressibility and fluidity.

Further, the raw material powder for powder metallurgy of the present invention is used to produce the sintered body when sintered at the temperature of not lower than 500° C. Particularly, the raw material powder for powder metallurgy is obtained by mixing together a metal powder, a first lubricant and a second lubricant. Here, the first lubricant is either melamine cyanurate or terephthalic acid.

As the second lubricant, there can be employed a known lubricant. As a lubricant, by combining a known lubricant with either melamine cyanurate or terephthalic acid, lubricity can be improved as compared to a case where melamine cyanurate or terephthalic acid is used solely, thereby allowing the life of the mold to be extended. Further, since the amount of a known lubricant used can be reduced, not only stains and surface defects can be restricted from occurring, but the density of the sintered material can be improved as well. Here, it is particularly preferred that the second lubricant be erucic acid amide or stearic acid amide. That is, by employing erucic acid or stearic acid amide as the second lubricant, not only stains can be restricted from occurring, but a high lubricity can be achieved as well.

It is preferred that melamine cyanurate, terephthalic acid, erucic acid amide and stearic acid amide used in the present invention each have an average particle diameter of 0.1 to 200 μm. An average particle diameter greater than 200 μm causes inner defects of the sintered body, whereas an average particle diameter smaller than 0.1 μm easily leads to secondary aggregation. Further, it is more preferred that melamine cyanurate used in the present invention have an average particle diameter of 0.1 to 3 μm. An average particle diameter greater than 3 μm degenerates the fluidity of the raw material powder for powder metallurgy. In the meantime, it is more preferred that erucic acid amide used in the present invention have an average particle diameter of 60 to 200 μm. The fluidity of the raw material powder for powder metallurgy will be degenerated if employing an average particle diameter smaller than 60 μm. If combining melamine cyanurate and erucic acid amide, it is preferred that a compounding ratio of melamine cyanurate to erucic acid amide be in a range of 90 to 50%:10 to 50%. Also, if combining melamine cyanurate and stearic acid amide, it is preferred that a compounding ratio of melamine cyanurate to stearic acid amide be in a range of 90 to 10%:10 to 90%. By employing a compounding ratio of such range, all the compressibility, lubricity and fluidity at the time of performing molding can be satisfied. In addition, if combining together or solely using one of melamine cyanurate and terephthalic acid, all the compressibility, lubricity and fluidity at the time of performing molding can be satisfied especially when carrying out warm forming.

Further, as is the case with conventional raw material powders for powder metallurgy, by allowing, for example, a lubricant or graphite to adhere to a metal powder, an apparent density or a rate of change in dimension at the time of performing molding as well as sintering can be controlled; and segregation, fluidity or compressibility, for example, can also be improved. The metal powder is not limited to an iron powder, but may be an other metal powder such as a copper powder, an aluminum powder or the like. Moreover, as is the case with conventional raw material powders for powder metallurgy, by changing the form and specific surface area of the lubricant, the apparent density or the rate of change in dimension at the time of performing molding as well as sintering can be controlled; and segregation, fluidity or compressibility, for example, can also be improved. The form and specific surface area of a lubricant can be changed as follows. That is, an atomization method, for example, can be employed to achieve a round form, and a crushing method, for example, can be employed to increase the surface area.

Described hereunder are specific working examples of the raw material powder for powder metallurgy of the present invention. However, the present invention is not limited to the following working examples, but can be modified in various ways.

WORKING EXAMPLES (1) Stain and surface defect of sintered body

Stains and surface defects of the sintered bodies were studied

As a metal powder, an iron powder (Atmel 300M by Kobe Steel, Ltd.) was used. As lubricants, there were used a melamine cyanurate powder (referred to as "M" hereunder) having an average particle diameter of 2 μm; a terephthalic acid powder (referred to as "T" hereunder) having an average particle diameter of 100 μm; an ethylenebis-stearic acid amide powder (referred to as "B" hereunder) having an average particle diameter of 20 μm; an erucic acid amide powder (referred to as "E" hereunder) having an average particle diameter of 50 μm; a stearic acid amide powder (referred to as "S" hereunder) having an average particle diameter of 50 μm; and a stearic acid zinc powder (referred to as "Z" hereunder) having an average particle diameter of 20 μm.

A raw material powder was prepared by placing the iron powder and the lubricants into a V-cone mixer and then mixing the same for about 20 minutes. The lubricants were added in an amount of 1% by mass to the raw material powder. The raw material powder was then molded to produce a disc-shaped compact of about 500 g. Molds that were used to perform the molding were the ones that had not less than Rz 5 μm surface roughness, and had already produced hundreds of thousands of compacts. Subsequently, the compact was roasted at 650° C. and sintered at 1140° C. under a reductive atmosphere of RX gas to produce a sintered body. The sintered bodies thus obtained were evaluated by comparing the same with one another with a five-level rating system where a visible amount of stains was classified as large, medium, small, minimal and none. In addition, the sintered bodies were also evaluated by comparing the same with one another with a three-level rating system where a presence of a surface defect(s) were classified as large, small and none. Such results are shown in the following table.

TABLE 1

| | Compounding ratio of each lubricant to total lubricants | | | | | | Amount | Surface |
|---|---|---|---|---|---|---|---|---|
| | M | T | B | E | S | Z | of stains | defect |
| Working example 1 | 100% | | | | | | None | None |
| Working example 2 | | 100% | | | | | None | None |
| Working example 3 | 70% | 30% | | | | | None | None |
| Working example 4 | 70% | | | 30% | | | Minimal | Small |
| Working example 5 | 70% | | | | 30% | | Minimal | Small |
| Working example 6 | 70% | | 30% | | | | Small | Small |
| Working example 7 | 70% | | | | | 30% | Medium | Small |
| Comparative example 1 | | | | | | 100% | Large | Large |
| Comparative example 2 | | | 100% | | | | Medium | Large |
| Comparative example 3 | | | | 100% | | | Small | Large |
| Comparative example 4 | | | | | 100% | | Small | Large |

The evaluation results indicate that the amounts of stains are low in working examples 1 to 7 where M or T was used. As for surface defects, a large agglomerate(s) of lubricant were formed on the surface of the sintered body of each of comparative examples 1 to 4 where only one of Z, B, E and S was used, which constituted the surface defects of the sintered bodies. In contrast, as for the working examples 1 to 7 where either M or T was used, the agglomerate(s) of lubricant were not formed at all or only formed in a small amount, which did not constitute the surface defects of the sintered bodies.

Figure 2:
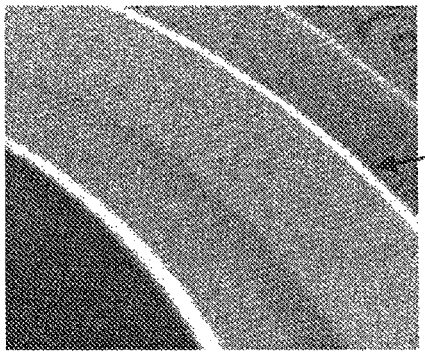
FIG. 2 is a photograph showing the top surface of a sintered body according to a working example of the invention where only melamine cyanurate was used as the lubricant.

FIG. 1 is a photograph showing the surface of the sintered body of the comparative example 2 where only B was used as the lubricant. Particularly, this photograph is an enlarged view taken from above the disc-shaped sintered body, and it can be seen that multiple dot-shaped stains are present on the bottom portion of the disc shape. Meanwhile, FIG. 2 is a photograph showing the surface of the sintered body of the working example 1 where only M was used as the lubricant. While the portion shown in FIG. 2 is identical to that shown in FIG. 1, it can be seen that there exists no stain.

Figure 3:
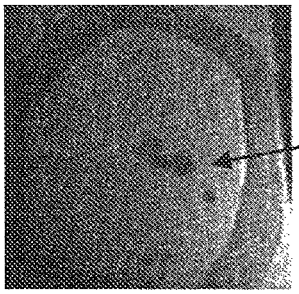
FIG. 3 is a photograph showing the side surface of the sintered body according to the comparative example where only ethylenebisstearamide was used as the lubricant.
Figure 4:
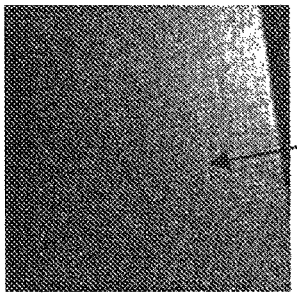
FIG. 4 is a photograph showing the side surface of the sintered body according to the working example of the invention where only melamine cyanurate was used as the lubricant.

FIG. 3 is a photograph showing the surface of the sintered body of the comparative example 2 where only B was used as the lubricant. Particularly, this photograph is an enlarged side view of the sintered body, and it can be seen that there exists a surface defect where the sintered body looks blackish in part due to a depressed area(s) formed thereon. In contrast, FIG. 4 is a photograph showing the surface of the sintered body of the working example 1 where only M was used as the lubricant. While the portion shown in FIG. 4 is identical to that shown in FIG. 3, it can be seen that there exists no surface defect.

(2) Compressibility, lubricity and fluidity of raw material powder

Next, the compressibility, lubricity and fluidity of the raw material powder were studied.

As a metal powder, an iron powder (Atmel 300M by Kobe Steel, Ltd.) was used. As lubricants, there were used a melamine cyanurate powder (referred to as "M" hereunder) having an average particle diameter of about 2 μm; an erucic acid amide powder (referred to as "E" hereunder) having an average particle diameter of 50 μm; an erucic acid amide powder (referred to as "F" hereunder) having an average particle diameter of 70 μm; a melamine cyanurate powder (referred to as "N" hereunder) having an average particle diameter of about 4 μm; a stearic acid amide powder (referred to as "S" hereunder) having an average particle diameter of about 50 μm; a terephthalic acid powder (referred to as "T" hereunder) having an average particle diameter of 100 μm; and a stearic acid zinc powder (referred to as "Z" hereunder) having an average particle diameter of about 20 μm.

Moreover, as additive agents, there were used a copper powder (CE-20 by FUKUDA METAL FOIL & POWDER Co., LTD) and a graphite powder (CPB-S by Nippon Graphite Industries, ltd.).

A raw material powder was prepared by placing the iron powder and the lubricants into a V-cone mixer and then mixing the same for about 20 minutes. As for the amounts of the additive agents added, the copper powder and the graphite powder were respectively added in an amount of 2% by mass and an amount of 0.7% by mass to the raw material powder. The fluidity of the raw material powder was then measured in accordance with JIS Z-2502. Later, the mixed raw material powder was molded under a condition where a mold was either at ambient temperature or a temperature of 150° C.; and a molding pressure was 8 t/cm$^2$, such that a cylindrical compact weighing about 7 g and having a punching area of 1 cm$^2$ could be produced. The compact density of the compact thus produced was then measured. And, the lubricity of the compact was evaluated based on a pulling energy generated at the time of forming the compact. Specifically, this pulling energy was measured as the total amount of energy required to pull out the cylindrical compact formed from the mold at a rate of 1 cm/min. The results thereof are shown in the following table.

TABLE 2

| | Molding temperature | Compounding ratio of each lubricant to total lubricants (mass %) | | | | | | | Fluidity | Compact density | Pulling energy |
|---|---|---|---|---|---|---|---|---|---|---|---|
| | (° C.) | M | E | F | N | S | T | Z | (s/50 g) | (g/cm$^3$) | (J) |
| Working example 8 | Ambient temperature | 90 | 10 | | | | | | 35.9 | 7.27 | 150 |
| Working example 9 | Ambient temperature | 80 | 20 | | | | | | 35.3 | 7.24 | 101 |
| Working example 10 | Ambient temperature | 70 | 30 | | | | | | 34.6 | 7.20 | 75 |
| Working example 11 | Ambient temperature | 60 | 40 | | | | | | 33.2 | 7.19 | 70 |
| Working example 12 | Ambient temperature | 50 | 50 | | | | | | No fluidity | | |
| Working example 13 | Ambient temperature | 50 | | 50 | | | | | 32.3 | 7.17 | 97 |
| Working example 14 | Ambient temperature | 40 | | 60 | | | | | No fluidity | | |
| Working example 15 | Ambient temperature | | | | 100 | | | | No fluidity | | |
| Working example 16 | Ambient temperature | 90 | | | | 10 | | | 35.9 | 7.30 | 152 |
| Working example 17 | Ambient temperature | 70 | | | | 30 | | | 35.9 | 7.23 | 129 |
| Working example 18 | Ambient temperature | 50 | | | | 50 | | | 36.1 | 7.21 | 111 |
| Working example 19 | Ambient temperature | 30 | | | | 70 | | | 32.5 | 7.16 | 92 |
| Working example 20 | Ambient temperature | 10 | | | | 90 | | | 31.9 | 7.13 | 75 |
| Working example 21 | Ambient temperature | 100 | | | | | | | 35.5 | 7.30 | 177 |
| Working example 22 | Ambient temperature | 90 | | | | | 10 | | 33.1 | 7.31 | 176 |
| Working example 23 | Ambient temperature | 70 | | | | | 30 | | 32.6 | 7.30 | 178 |
| Working example 24 | Ambient temperature | 50 | | | | | 50 | | 33.0 | 7.27 | 177 |
| Working example 25 | Ambient temperature | 30 | | | | | 70 | | 32.7 | 7.25 | 172 |
| Working example 26 | Ambient temperature | 10 | | | | | 90 | | 32.2 | 7.23 | 175 |
| Working example 27 | Ambient temperature | | | | | | 100 | | 25.5 | 7.23 | 181 |
| Working example 28 | 150 | 100 | | | | | | | 31.5 | 7.34 | 151 |
| Working example 29 | 150 | 90 | | | | | 10 | | 29.6 | 7.36 | 140 |
| Working example 30 | 150 | 70 | | | | | 30 | | 27.9 | 7.35 | 146 |
| Working example 31 | 150 | 50 | | | | | 50 | | 27.4 | 7.32 | 137 |
| Working example 32 | 150 | 30 | | | | | 70 | | 26.6 | 7.28 | 123 |
| Working example 33 | 150 | 10 | | | | | 90 | | 25.8 | 7.27 | 127 |
| Working example 34 | 150 | | | | | | 100 | | 26.3 | 7.26 | 148 |
| Comparative example 5 | 150 | | | 100 | | | | | No fluidity | | |
| Comparative example 6 | 150 | | | | | 100 | | | No fluidity | | |
| Comparative example 7 | Ambient temperature | | | | | | | 100 | 32.1 | 7.17 | 133 |
| Comparative example 8 | 150 | | | | | | | 100 | No fluidity | 7.28 | 151 |

As for the results of the fluidity evaluation, unfavorable fluidities were confirmed in a working example 12 where E was used in an amount of 50% by mass; a working example 14 where F was used in an amount of 60% by mass; a working example 15 where only N was used; a comparative example 5 where only F was used and the molding temperature was 150° C.; a comparative example 6 where only S was used and the molding temperature was 150° C.; and the comparative example 8 where only Z was used and the molding temperature was 150° C. In fact, the fluidities of these working and comparative examples were so unfavorable that they could not even be measured by a fluidimeter. Particularly, the fluidity of a working example 13 using F was higher than that of the working example 12 using E. And, the fluidity of a working example 21 using M was higher than that of the working example 15 using N. In terms of the fluidities at the temperature of 150° C., the fluidities of working examples 28 and 34 respectively using M and T were higher than those of the comparative examples 5, 6 and 8 respectively using F, S and Z. As for the compressibilities when performing molding at ambient temperature, it was confirmed that, as compared to the comparative example 5 using Z, the working examples 8 to 11, 16 to 18 and 21 to 27 had exhibited improved compact densities and compressibilities accordingly. As for the compressibilities when performing warm forming at 150° C., it was confirmed that, as compared to the comparative example 8 using Z, working examples 28 to 31 had exhibited improved compact densities and compressibilities accordingly. As for the lubricities when performing molding at ambient temperature, it was confirmed that, as compared to a comparative example 7 using Z, working examples 9 to 11, 13, 17 to 20 using M and; E, F or S had exhibited higher lubricities due to small pulling energies. As for the lubricities when performing warm forming at 150° C., it was confirmed that, as compared to the comparative example 8 using Z, working examples 29 to 34 had exhibited higher lubricities due to small pulling energies. Further, it was confirmed that, as compared to the working examples 21 to 27, the working examples 28 to 34 where warm forming was performed at 150° C. had exhibited small pulling energies i.e. the lubricities of the lubricants M and T were confirmed to be higher in the case of warm forming than forming performed at ambient temperature. As for the lubricants M and T, the temperature at which warm forming is performed can even be raised to those near the decomposition temperatures thereof. In such case, the compressibility is expected to improve even more.

(3) Decarburization of sintered body

Next, the decarburization of the sintered bodies was studied.

As a metal powder, the iron powder (Atmel 300M by Kobe Steel, Ltd.) was used. As lubricants, there were used a melamine cyanurate powder (referred to as "M" hereunder) having an average particle diameter of 2 μm; and a stearic acid zinc powder (referred to as "Z" hereunder) having an average particle diameter of 20 μm.

Further, as additive agents, there were used the copper powder (CE-20 by FUKUDA METAL FOIL & POWDER Co., LTD) and a graphite powder (CPB-S by Nippon Graphite Industries, ltd.).

A raw material powder was then prepared by placing the iron powder and the lubricants into a V-cone mixer and then mixing the same for about 20 minutes. The lubricants were added in an amount of 1% by mass to the raw material powder. As for the amounts of the additive agents added, the copper powder and the graphite powder were respectively added in an amount of 2% by mass and an amount of 0.7% by mass to the raw material powder. The raw material powder was then molded under a molding pressure of 4 t/cm$^2$ to obtain a rod-shaped compact having a dimension of 60 mm×10 mm×10 mm. Later, the compact was heated at 500° C. for 40 minutes in the atmosphere, and was then cooled by being left in the atmosphere followed by measuring the amount of graphite remaining in the compact. The results thereof are shown in the following table.

TABLE 3

| | Lubricant | Amount of residual graphite |
|---|---|---|
| Working example 35 | M | 0.70% |

TABLE 3-continued

| | Lubricant | Amount of residual graphite |
|---|---|---|
| Comparative example 9 | Z | 0.65% |

The evaluation results indicate that decarburization occurred in a comparative example 9 using Z where the loss of graphite was confirmed by an amount 0.05% by mass to the original amount of 0.7% by mass, whereas the amount of graphite was maintained in a working example 35 using M. That is, it was confirmed that M was more resistant to decarburization than Z.

(4) Density and strength of sintered body

Next, the densities and strengths of the sintered bodies were studied.

As a metal powder, the iron powder (Atmel 300M by Kobe Steel, Ltd.) was used. As lubricants, there were used a melamine cyanurate powder (referred to as "M" hereunder) having an average particle diameter of 2 μm; and a stearic acid zinc powder (referred to as "Z" hereunder) having an average particle diameter of 20 μm.

Further, as additive agents, there were used the copper powder (CE-20 by FUKUDA METAL FOIL & POWDER Co., LTD) and a graphite powder (CPB-S by Nippon Graphite Industries, ltd.).

Figure 5:
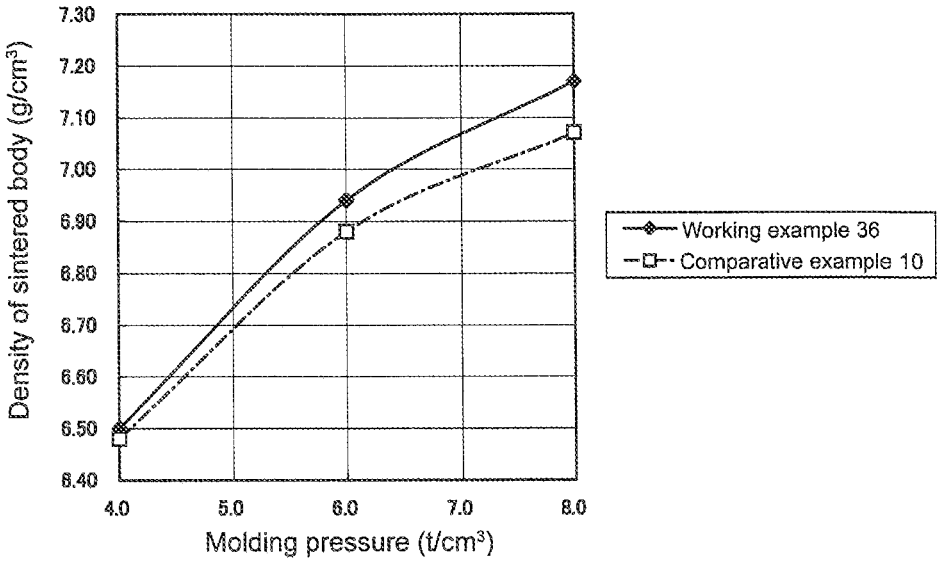
FIG. 5 is a graph comparing density between the sintered bodes.
Figure 6:
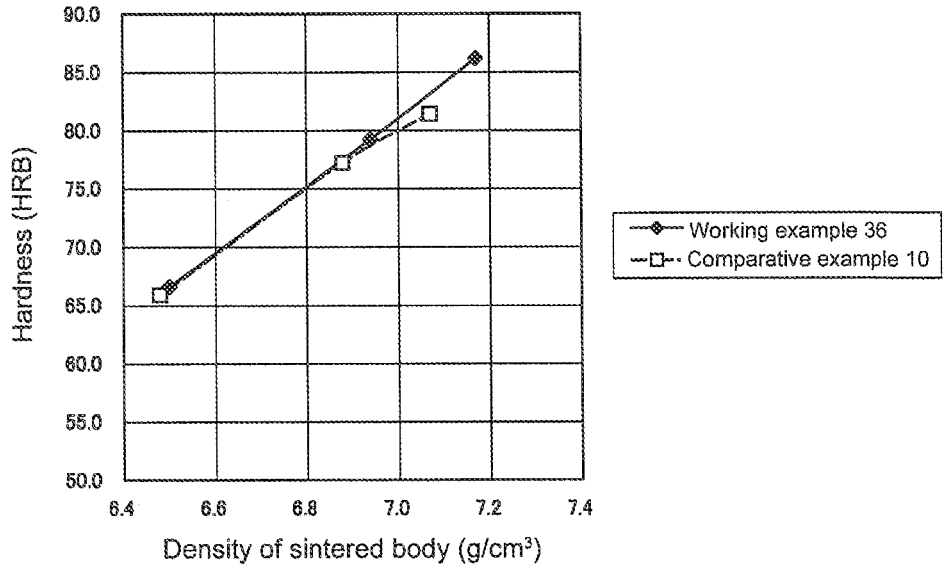
FIG. 6 is a graph comparing hardness between the sintered bodes.
Figure 7:
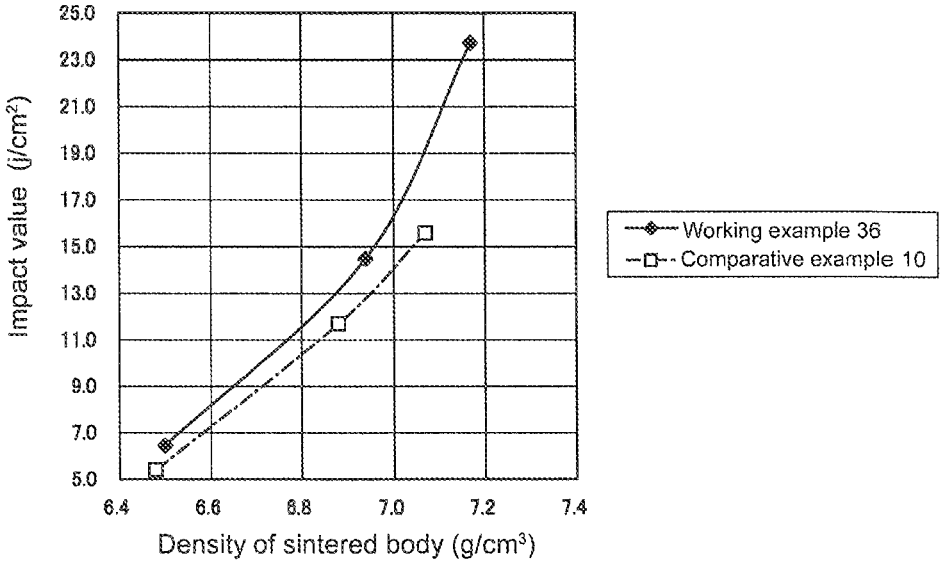
FIG. 7 is a graph comparing impact value between the sintered bodes.

A raw material powder was then prepared by placing the iron powder and the lubricants into a V-cone mixer and then mixing the same for about 20 minutes. The lubricants were added in an amount of 0.75% by mass to the raw material powder. As for the amounts of the additive agents added, the copper powder and the graphite powder were respectively added in an amount of 2% by mass and an amount of 0.7% by mass to the raw material powder. The raw material powder was then molded under molding pressures of 4 t/cm$^2$, 6 t/cm$^2$ and 8 t/cm$^2$ to obtain a rod-shaped compact having a dimension of 60 mm×10 mm×10 mm. Later, the compact was roasted at 650° C. and sintered at 1140° C. under a reductive atmosphere of RX gas to produce a sintered body. The sintered-body density, hardness and impact value of the sintered body thus obtained were respectively measured in accordance with JIS Z 2501, JIS Z 2245 and JIS Z 2242. The results thereof are shown in the following table and FIG. 5 to FIG. 7.

TABLE 4

| | Lubricant | Molding pressure t/cm$^2$ | Density of sintered body g/cm$^3$ | Hardness HRB | Impact value J/cm$^2$ |
|---|---|---|---|---|---|
| Working example 36 | M | 4 | 6.50 | 66.6 | 6.4 |
| | | 6 | 6.94 | 79.2 | 14.5 |
| | | 8 | 7.17 | 86.2 | 23.7 |
| Comparative example 10 | Z | 4 | 6.48 | 65.9 | 5.4 |
| | | 6 | 6.88 | 77.2 | 11.7 |
| | | 8 | 7.07 | 81.4 | 15.6 |

According to the evaluation results, it was confirmed that an increase in sintered-body density due to an increase in the molding pressure was more significant in a working example 36 than a comparative example 10. Therefore, it was again confirmed that the sintered-body density was higher i.e. the compressibility had been improved when using M rather than Z as a lubricant.

Further, although the hardnesses of the working example 36 and comparative example 10 were equivalent to each other under an identical sintered-body density, the hardness of the working example 36 was confirmed to be higher under an identical molding pressure. As for the impact value, the working example 36 exhibited a higher value under both an identical sintered-body density and an identical molding pressure. Therefore, it was confirmed that the strength of the sintered body was higher when using M rather than Z as a lubricant.

(5) Strength of Quenched Body

The strengths of the quenched bodies were studied.

Figure 8:
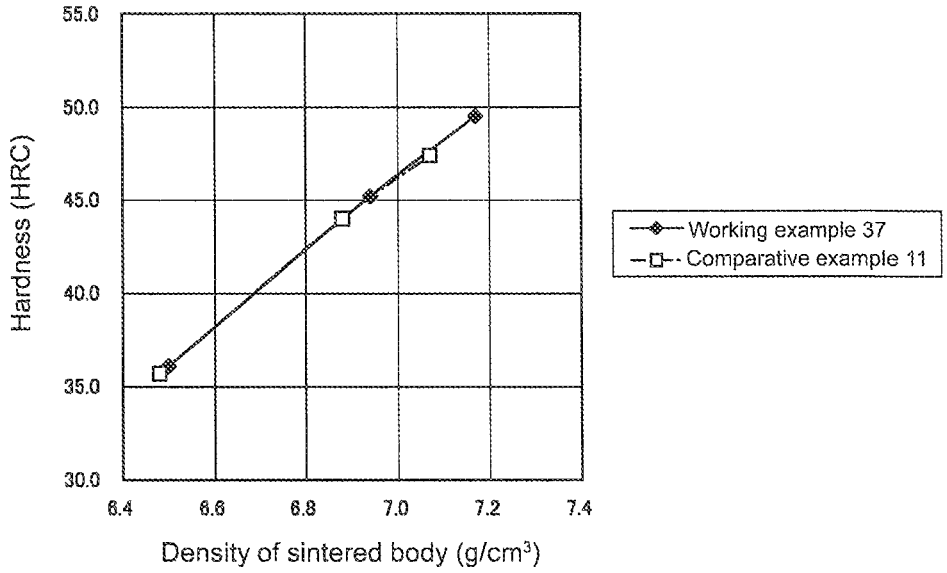
FIG. 8 is a graph comparing hardness between quenched bodes.
Figure 9:
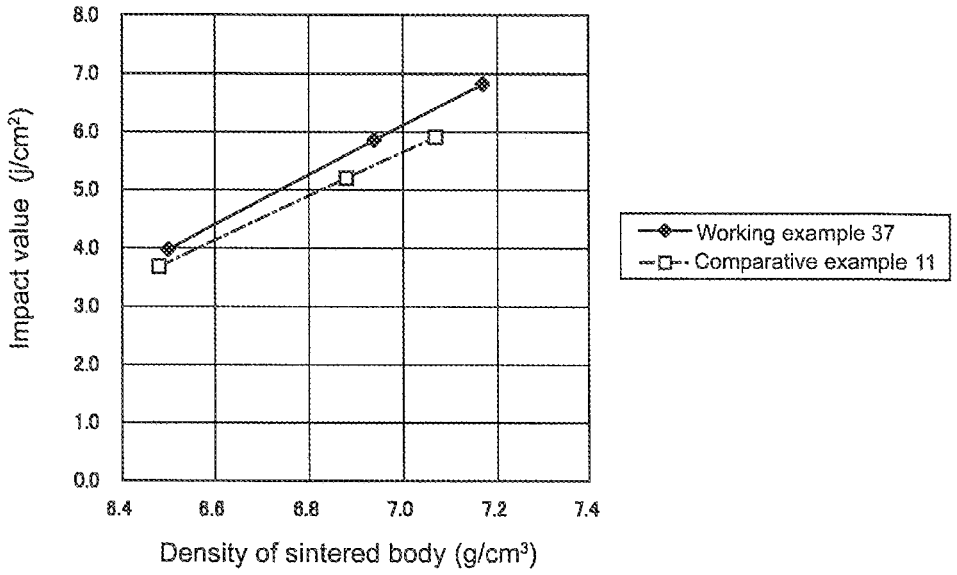
FIG. 9 is a graph comparing impact value between the quenched bodes.

The sintered bodies evaluated in "(4) Density and strength of sintered body" were then heated at 870° C., and were later oil quenched at 60° C. before being tempered at 160° C., thus obtaining quenched bodies. The hardnesses and impact values of the quenched bodies thus obtained were respectively measured in accordance with JIS Z 2245 and JIS Z 2242. The results thereof are shown in the following table and FIG. 8 to FIG. 9.

TABLE 5

| | Lubricant | Molding pressure t/cm$^2$ | Density of sintered body g/cm$^3$ | Hardness HRC | Impact value J/cm$^2$ |
|---|---|---|---|---|---|
| Working example 37 | M | 4 | 6.50 | 36.1 | 4.0 |
| | | 6 | 6.94 | 45.2 | 5.9 |
| | | 8 | 7.17 | 49.5 | 6.8 |

TABLE 5-continued

| | Lubricant | Molding pressure t/cm$^2$ | Density of sintered body g/cm$^3$ | Hardness HRC | Impact value J/cm$^2$ |
|---|---|---|---|---|---|
| Comparative example 11 | Z | 4 | 6.48 | 35.7 | 3.7 |
| | | 6 | 6.88 | 44.0 | 5.2 |
| | | 8 | 7.07 | 47.4 | 5.9 |

The evaluation results indicate that although the hardnesses of a working example 37 and a comparative example 11 were equivalent to each other under an identical sintered-body density, the hardness of the working example 37 was higher under an identical molding pressure. As for the impact value, the working example 37 exhibited a higher value under both an identical sintered-body density and an identical molding pressure. Therefore, it was confirmed that the strength of the quenched body was higher when using M rather than Z as a lubricant.

The invention claimed is:

1. A raw material powder for powder metallurgy that is sintered at a temperature of not lower than 500° C. and used to produce a sintered body, consisting of;

a mixture of a metal powder;

a lubricant; and an additive agent, wherein the lubricant is melamine cyanurate, and the additive agent is a graphite powder.

2. The raw material powder for powder metallurgy according to claim 1, wherein said lubricant has an average particle diameter of 0.1 to 200 μm.

* * * * *